US006548749B2

(12) United States Patent
Suda

(10) Patent No.: US 6,548,749 B2
(45) Date of Patent: Apr. 15, 2003

(54) ELECTRONIC MUSICAL INSTRUMENT AND TONE VOLUME CONTROL METHOD

(75) Inventor: Masayuki Suda, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 10/003,975

(22) Filed: Oct. 25, 2001

(65) Prior Publication Data

US 2002/0069748 A1 Jun. 13, 2002

(30) Foreign Application Priority Data

Oct. 31, 2000 (JP) ..... 2000-333228

(51) Int. Cl.[7] ..... G10H 1/08; G10H 1/12; G10H 1/46

(52) U.S. Cl. ..... 84/660; 84/661; 84/665; 84/DIG. 9; 381/104; 381/118

(58) Field of Search ..... 84/608, 622–625, 84/633, 659–661, 665, 692–700, 711, DIG. 9; 381/104–109, 118

(56) References Cited

U.S. PATENT DOCUMENTS 4,300,432 A * 11/1981 Deutsch ..... 84/633 X
4,301,704 A * 11/1981 Nagai et al. ..... 84/633 X
4,314,496 A * 2/1982 Beigel ..... 84/711 X
4,384,506 A * 5/1983 Amano et al. ..... 84/711 X
4,991,485 A * 2/1991 Takauji ..... 84/608

* cited by examiner

*Primary Examiner*—Stanley J. Witkowski
(74) *Attorney, Agent, or Firm*—Christie, Parker & Hale, LLP

(57) ABSTRACT

Multipliers respectively multiply a tone signal supplied from a sound source and a tone signal corrected by a filter according to hearing correction characteristics by balance control coefficients generated by a control coefficient generator based on tone volume control data, and an adder adds the products to adjust the tone volume balance. A multiplier multiplies the tone signal output from that adder by a tone volume control coefficient generated by the control coefficient generator based on the tone volume control data to adjust the tone volume. Frequency characteristics for correcting hearing characteristics are given to the tone signal in accordance with the tone volume of tones to be generated, thus maintaining tone volume balance upon hearing among tone colors of tones to be generated by an electronic musical instrument.

14 Claims, 11 Drawing Sheets

ELECTRONIC MUSICAL INSTRUMENT AND TONE VOLUME CONTROL METHOD

CROSS-REFERENCE TO RELATED APPLICATIONS

This application is based upon and claims priority of Japanese Patent Applications No. 2000-333228, filed on Oct. 31, 2000, the contents being incorporated herein by reference.

BACKGROUND OF THE INVENTION

1. Field of the Invention

The present invention relates to an electronic musical instrument and tone volume control method and, more particularly, to a technique which is suitably used in an electronic musical instrument for correcting a tone signal in accordance with given frequency characteristics in correspondence with the tone volume of a tone to be generated, and generating the tone.

2. Description of the Related Art

A conventional electronic musical instrument such as an electronic organ, electronic keyboard, and the like comprises a volume switch for setting a tone volume, and an expression pedal (to be referred to as an "EXP pedal" hereinafter) for inflecting tones by controlling the tone volume during a performance. The electronic musical instrument controls the volume of tones to be generated in accordance with the operations of the volume switch and EXP pedal. Also, an electronic musical instrument which has an external interface such as a MIDI (Musical Instrument Digital Interface) or the like controls the volume of tones to be generated on the basis of supplied automatic performance data such as MIDI data or the like.

The volume of tones generated by the electronic musical instrument is controlled by changing the volume of all tones generated in accordance with the operation state of the volume switch or EXP pedal without changing the electric frequency characteristics. That is, the volume of tones generated is controlled by changing all frequency components of tone signals of tones generated by the electronic musical instrument by the same amount.

However, as is generally known as equal loudness contours (Fletcher-Munson contours), the human ear has different hearing frequency characteristics (to be referred to as "hearing characteristics" hereinafter) depending on the tone volume. The human ear is highly sensitive to tones within the range of around 1 to 4 kHz but is less sensitive to tones having frequencies lower than this range (bass) and higher than that range (treble). Especially, it becomes harder for the human ear to hear bass tones with decreasing tone volume.

For this reason, in the aforementioned tone volume control of the electronic musical instrument, bass and treble tones of tone signals, which are optimal at a certain tone volume, become harder to hear by decreasing the tone volume, and midrange tones around 1 to 4 kHz are conspicuously easy to hear. For example, in tones containing a bass tone color, those of the bass tone color becomes harder to hear by decreasing the tone volume.

In the conventional tone volume control of the electronic musical instrument, when the volume of tones to be generated is changed, the balance among tone colors of tones to be generated by the electronic musical instrument, and the tone colors themselves sound differently depending on the hearing characteristics.

SUMMARY OF THE INVENTION

The present invention has been made to solve the aforementioned problems, and has as its object to maintain tone volume balance among tone colors of tones to be generated by an electronic musical instrument, and the tone colors themselves upon hearing independently of the tone volume of tones to be generated.

An electronic musical instrument of the present invention is an electronic musical instrument for generating a tone on the basis of a tone signal, comprising a filter having hearing correction characteristics for correcting the received tone signal, and a mixing unit for mixing the received tone signal and the tone signal, which is corrected by the filter, at a given ratio on the basis of tone volume control information used to control a tone volume of the tone to be generated, and outputting the mixed signal.

According to another feature of the present invention, the mixing unit comprises a balance adjustment unit for adjusting, on the basis of the coefficient, a tone volume balance of tones to be generated based on the received tone signal and the tone signal corrected by the filter, and a tone volume adjustment unit for adjusting, on the basis of the coefficient, the tone volume of tones to be generated based on the received tone signal and the tone signal corrected by the filter.

A tone volume control method of the present invention is a tone volume control method of controlling a tone volume of a tone to be generated based on a tone signal, comprising the step of correcting the received tone signal by a filter having hearing correction characteristics, and mixing the received tone signal and the tone signal corrected by the filter at a given ratio on the basis of tone volume control information used to control a tone volume of the tone to be generated, and outputting the mixed signal.

According to another feature of the tone volume control method of the present invention, upon mixing the received tone signal and the tone signal corrected by the filter at the given ratio on the basis of the coefficient, a tone volume balance of tones to be generated based on the received tone signal and the tone signal corrected by the filter is adjusted, and the tone volume of the tones to be generated is adjusted on the basis of the coefficient.

According to the present invention with the above arrangement, since the received tone signal and the tone signal which is corrected by the filter according to the hearing correction characteristics are mixed at a given ratio on the basis of tone volume control information that controls the tone volume, and the mixed signal is output, a tone signal to which frequency characteristics that correct the hearing characteristics are given can be generated and output in accordance with the tone volume of a tone to be generated.

Upon mixing the received tone signal and the tone signal which is corrected by the filter according to the hearing correction characteristics, when the tone volume balance of tones to be generated and the tone volume are separately adjusted on the basis of the received tone signal and the corrected tone signal, they can be independently adjusted, and a tone signal to which frequency characteristics that correct the hearing characteristics are given can be easily generated and output in accordance with the tone volume of a tone to be generated.

DETAILED DESCRIPTION OF THE PREFERRED EMBODIMENTS

Preferred embodiments of the present invention will be described hereinafter with reference to the accompanying drawings.

First Embodiment

Figure 1:
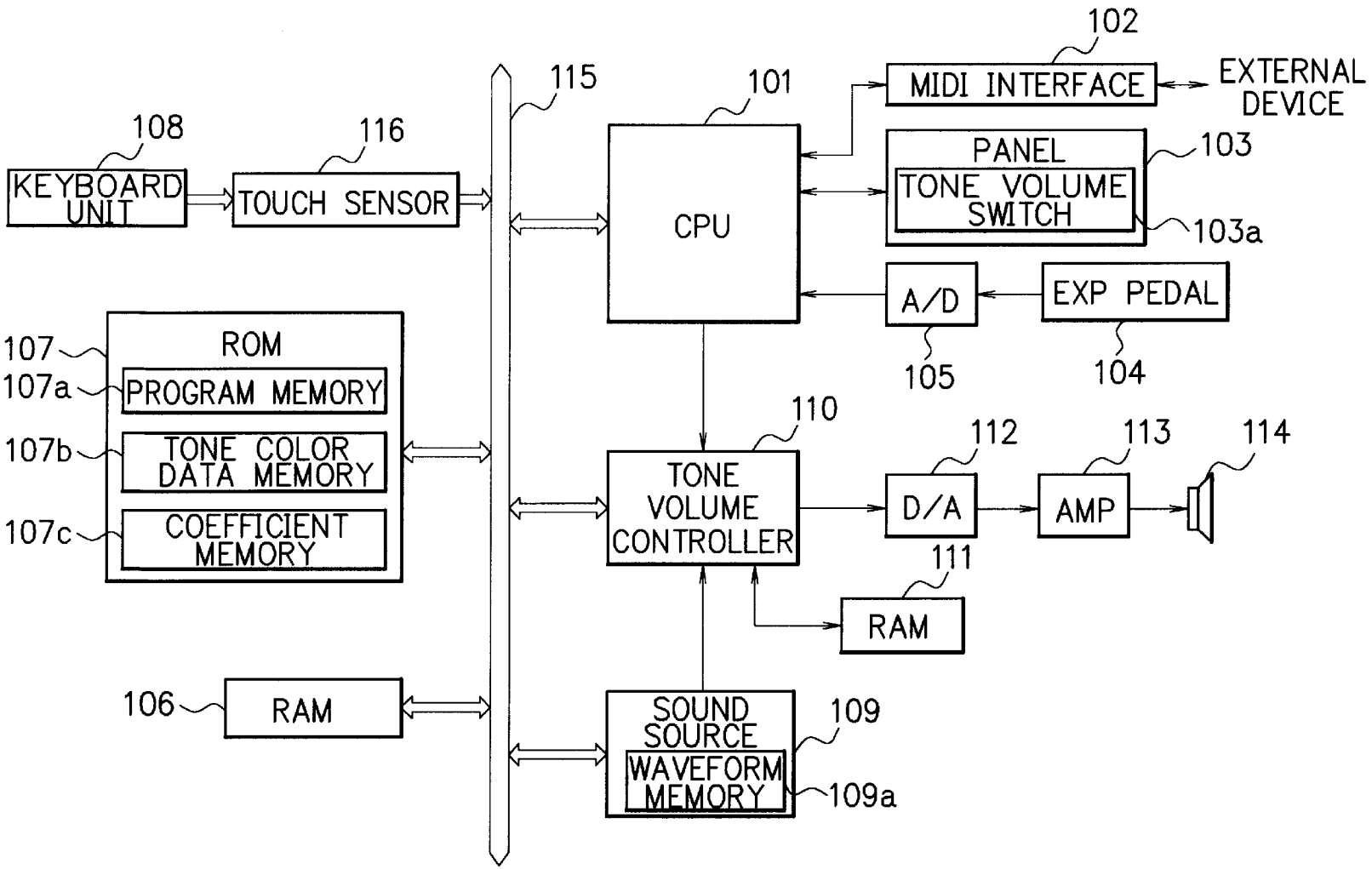
FIG. 1 is a block diagram showing the arrangement of an electronic musical instrument according to the first embodiment.

FIG. 1 is a block diagram showing the arrangement of an electronic musical instrument according to the first embodiment.

Referring to FIG. 1, reference numeral 101 denotes a CPU for controlling the operation of the electronic musical instrument in accordance with a processing program stored in a ROM 107. The CPU 101 is electrically connected to a MIDI interface 102 connected to an external device (not shown), a control panel 103 provided with a tone volume switch 103a and the like, and an EXP pedal 104 via an A/D converter 105. The EXP pedal 104 controls the tone volume during a performance to inflect tones, and the AID converter 105 converts an operation position signal or the like of the EXP pedal 104 into digital data.

The CPU 101 supplies performance data to a sound source 109 and the like on the basis of touch information of ON keys operated on a keyboard unit 108, pitch (range) information of the ON keys, and tone color information selected upon operation on the control panel 103 to control the sound source 109.

The CPU 101 supplies tone volume control data to a tone volume controller 110 in accordance with MIDI data supplied from the MIDI interface 102, and the operation states of the tone volume switch 103*a* on the control panel 103 and the EXP pedal 104, thereby controlling the tone volume of tones produced from a loudspeaker 114.

Reference numeral 106 denotes a RAM which has a storage area for temporarily storing various kinds of information during execution of various processes by the CPU 101, and storing information obtained as a result of various processes. The RAM 106 is used as a work area of the CPU 101.

The ROM 107 includes a program memory 107*a* for storing a processing program and the like, tone color data memory 107*b*, coefficient memory 107*c*, and the like. The coefficient memory 107*c* stores filter coefficients of a filter 201, coefficients used in arithmetic operations by a control coefficient generator 203, and the like in the tone volume controller 110. The filter 201 and control coefficient generator 203 will be explained later.

The keyboard unit 108 comprises one or a plurality of keyboards having a plurality of keys. Reference numeral 116 denotes a touch sensor, which detects ON and OFF key events, and key operation speed on the keyboard unit 108, and outputs touch information, pitch (range) information, and the like of the ON key in accordance with the detection result.

The sound source 109 includes a waveform memory 109*a* which stores PCM waveform data. The sound source 109 reads out PCM waveform data from the waveform memory 109*a* on the basis of performance data supplied from the CPU 101, generates a tone signal obtained by modifying the amplitude and envelope of the readout PCM waveform data, and supplies the tone signal to the tone volume controller 110.

The tone volume controller 110 changes a tone signal supplied from the sound source 109 on the basis of the tone control data supplied from the CPU 101 in accordance with given frequency characteristics, and outputs that tone signal to a D/A converter 112. That is, the tone volume controller 110 corrects a tone signal supplied from the sound source 109 on the basis of the tone volume control data in accordance with hearing frequency characteristics, to maintain the tone volume balance and tone colors upon hearing of tones to be produced by the loudspeaker 114 independently of the tone volume selected. The tone volume controller 110 supplies the corrected tone signal to the D/A converter 112.

The D/A converter 112 converts the corrected tone signal supplied from the tone volume controller 110 into an analog signal, and supplies the analog signal to the loudspeaker 114 via an amplifier 113. Note that the tone volume controller 110 comprises a DSP (Digital Signal Processor) in this embodiment.

A RAM 111 is a delay memory which temporarily holds a tone signal, and outputs the held tone signal.

Note that the CPU 101, RAM 106, ROM 10.7, sound source 109, and tone volume controller 110 are coupled via a bus 115 including a data bus, address bus, and the like, and can exchange data with each other. The keyboard unit 108 is coupled to the bus 115 via the touch sensor 116.

Figure 2:
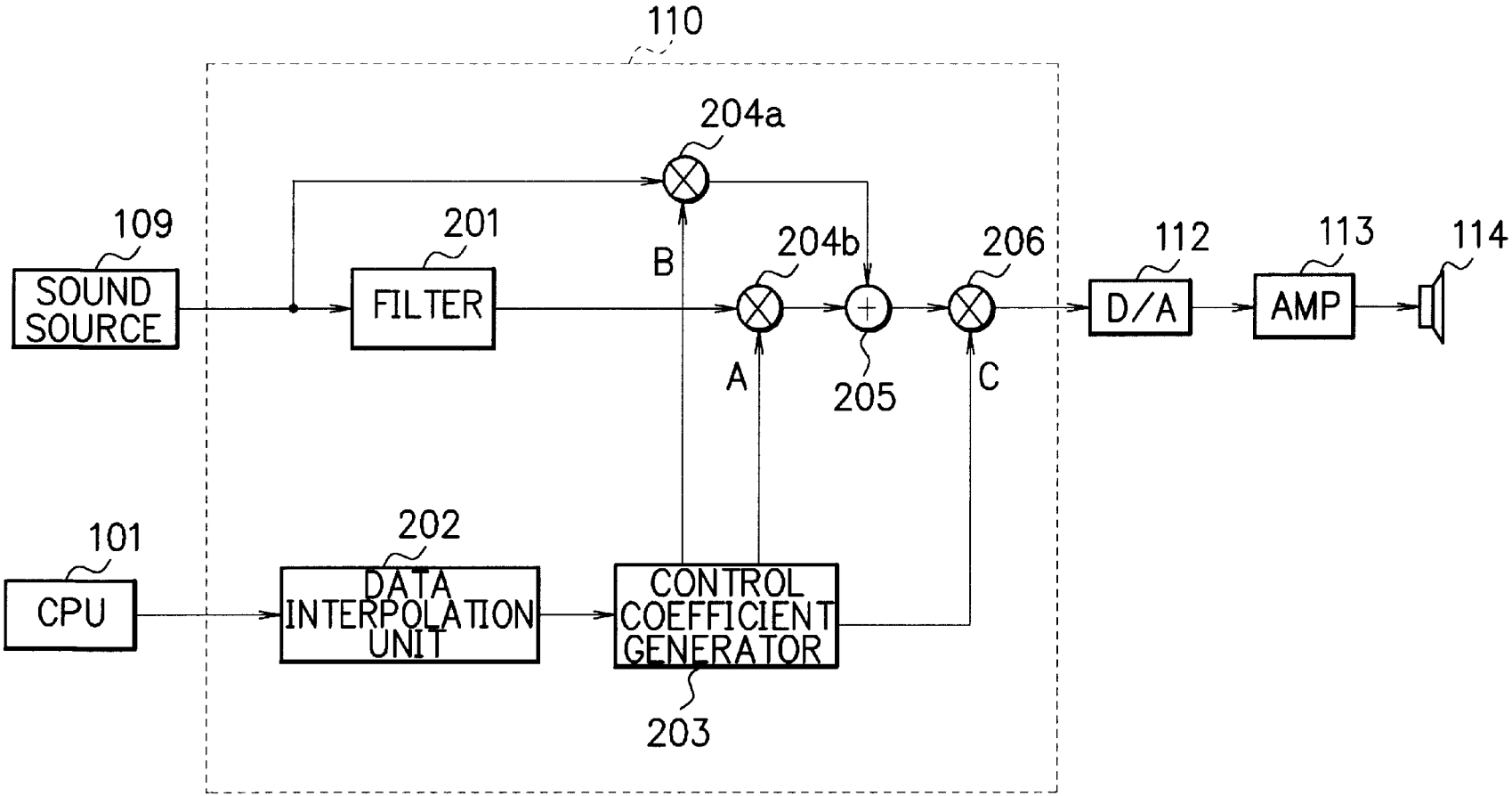
FIG. 2 is a block diagram showing the detailed arrangement of a tone volume controller 110 shown in FIG. 1.

FIG. 2 is a block diagram for explaining the detailed arrangement of the tone volume controller 110 shown in FIG. 1. Note that the same reference numerals in FIG. 2 denote the same blocks as those in FIG. 1, and a repetitive description thereof will be omitted.

Referring to FIG. 2, reference numeral 201 denotes a filter having hearing correction characteristics. The filter 201 corrects a tone signal supplied from the sound source 109 in accordance with the hearing correction characteristics, and outputs the corrected signal to a multiplier 204*b*. Note that the hearing correction characteristics are frequency characteristics that can provide the same tone volume balance and tone colors of tones upon hearing as those of tones generated at a large tone volume upon generating tones on the basis of tone signals at a minimum tone volume (except for a mute state) that the electronic musical instrument can generate.

For example, assume that tones generated by the electronic musical instrument have a tone volume dynamic range of 30 dB for bass and treble tones, and 44 dB for midrange tones. At this time, since the difference between the tone volume dynamic ranges of midrange tones and bass & treble tones is 14 dB, for example, frequency characteristics F74 (FIG. 7) having a maximum value of 0 dB and a minimum value of −14 dB are used as hearing correction characteristics.

Figure 3:
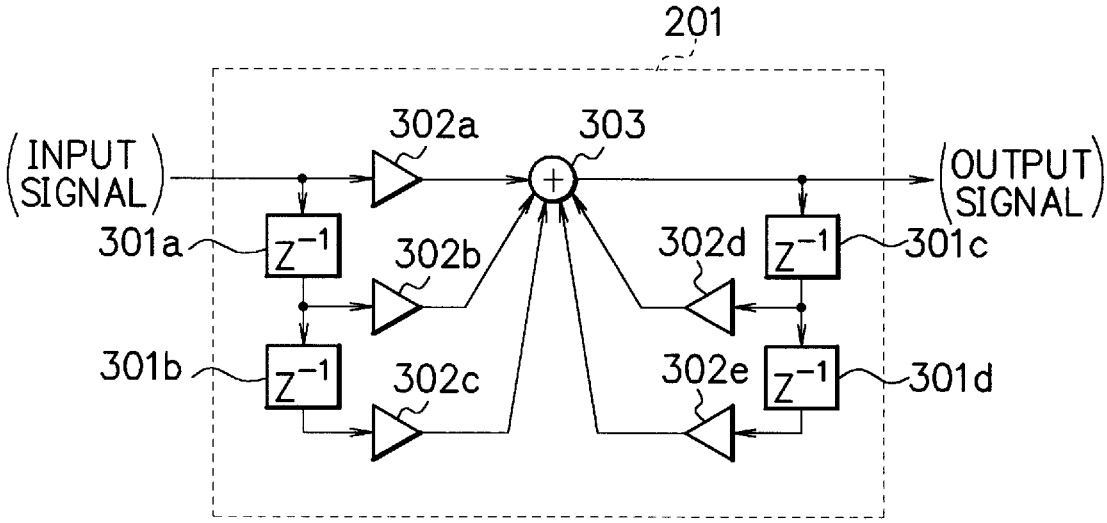
FIG. 3 is a block diagram showing the detailed arrangement of a filter 201 shown in FIG. 2.

FIG. 3 shows the detailed arrangement of the filter 201.

As shown in FIG. 3, the filter 201 is a second-order IIR filter comprising a combination of four delay circuits 301*a* to 301*d*, five multipliers 302*a* to 302*e*, and one adder 303.

Each of the delay circuits 301*a* to 301*d* delays an input signal one sampling time, and outputs the delayed signal. A signal delayed by the delay circuit 301*a* is input to the multiplier 302*b*, and is also input to the delay circuit 301*b* to be further delayed. The delayed signal output from the delay circuit 301*b* is input to the multiplier 302*c*. Similarly, a signal, which is output from the adder 303 and is delayed by the delay circuit 301*c*, is input to the multiplier 302*d*, and is also input to the delay circuit 301*d* to be further delayed. That delayed signal is input to the multiplier 302*e*.

Figure 7:
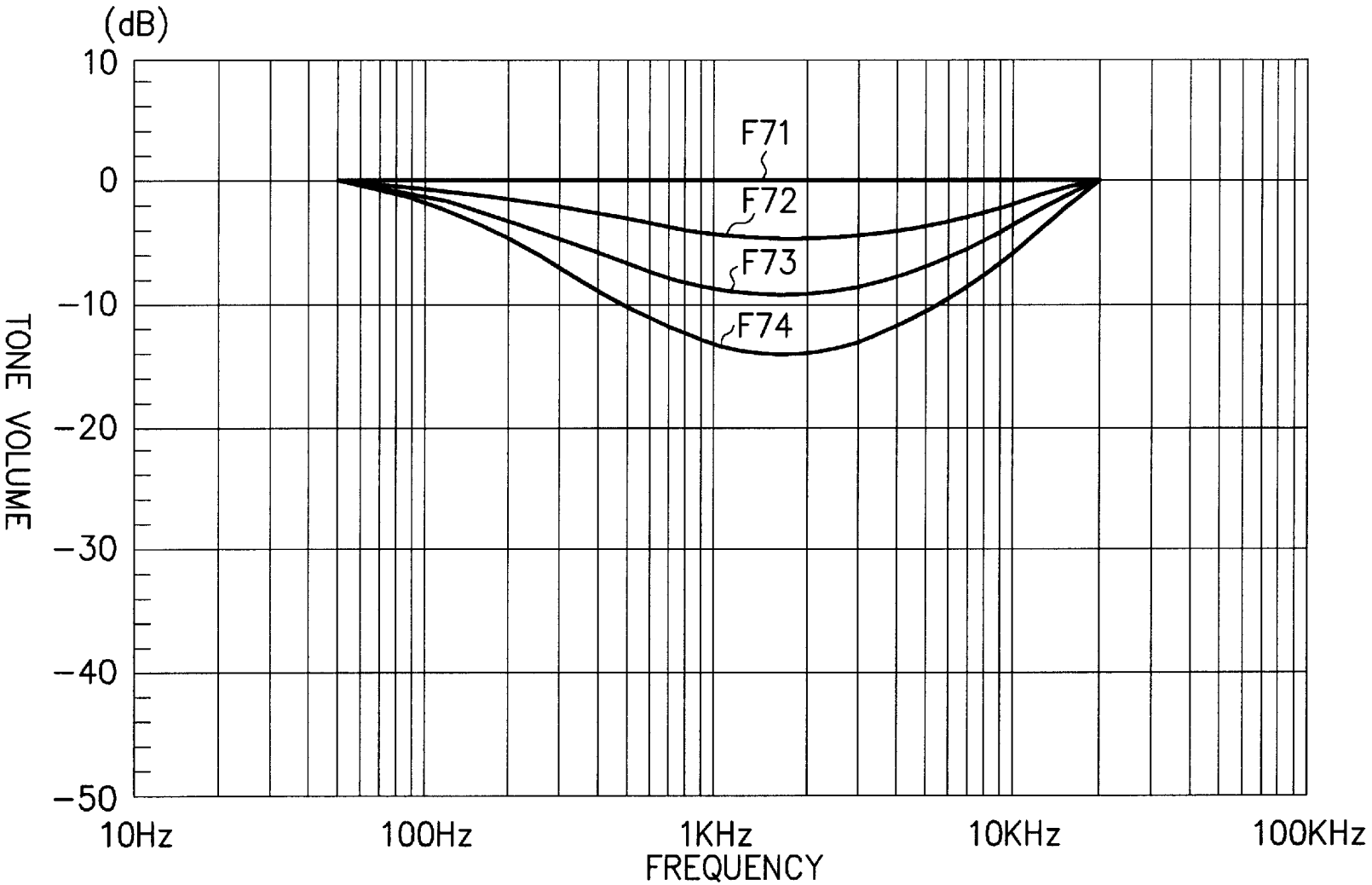
FIG. 7 is a graph for explaining the frequency characteristics of tone signals output from an adder 205 shown in FIG. 2.

The multipliers 302*a* to 302*e* multiply the received tone signal and delayed received tone signals by given coefficients so that the frequency characteristics of the filter 201 exhibit the frequency characteristics F74 shown in FIG. 7, i.e., hearing correction characteristics. The given coefficients to be multiplied by the multipliers 302*a* to 302*e* are stored in the coefficient memory 107*c* in the ROM 107 shown in FIG. 1, and are read out and supplied by the CPU 101 upon power ON.

The adder 303 adds the tone signals output from the multipliers 302*a* to 302*e*, and outputs the sum signal to the delay circuit 301*c* and also to the multiplier 204*b* (FIG. 2) as an output signal from the filter 201.

In this way, the filter 201 corrects the received tone signal in accordance with the hearing correction characteristics.

Referring back to FIG. 2, reference numeral 202 denotes a data interpolation unit which makes data interpolation of tone volume control data supplied from the CPU 101. Since the CPU 101 executes many processes in addition to an output process of the tone volume control data, it supplies the tone volume control data to the tone volume controller 110 at given time intervals (e.g., several-ms intervals). Therefore, when tone volume control is made directly using the tone volume control data supplied from the CPU 101, if the tone volume control data changes abruptly, discontinuous tone signals are generated, thus producing noise.

For this reason, the data interpolation unit 202 interpolates tone volume control data supplied from the CPU 101 at given time intervals to obtain those which indicate a smooth change in tone volume. The data interpolation unit 202 forms an interpolation unit of the present invention.

Data interpolation of the data interpolation unit 202 may be done to linearly interpolate inflection points of the received tone volume control data, or to always change inflection points of the received tone volume control data at a given change amount (acceleration). Also, data interpolation may be done to change to the value of the received tone volume control data until the next tone volume control data is supplied from the CPU 101, or the received tone volume control data may undergo a filter process using a low-pass filter (LPF) or the like to obtain smooth tone volume control data.

Reference numeral 203 denotes a control coefficient generator for generating balance control coefficients A and B and a tone volume control coefficient C from the tone volume control data that have undergone data interpolation by the data interpolation unit 202, and supplies them to the multiplier 204*b* and multipliers 204*a* and 206, respectively. The control coefficient generator 203 forms a coefficient generation unit of the present invention.

The balance control coefficients A and B are control coefficients used to adjust the tone volume balance upon hearing between a tone signal which is corrected according to the hearing correction characteristics and is supplied from the filter 201, and a tone signal which is directly supplied from the sound source 109 without going through the filter 201 in accordance with the tone volume. That is, the balance control coefficients A and B are used to adjust the tone volume balance upon hearing of tones to be generated by the electronic musical instrument to be constant independently of the tone volume. Note that the balance control coefficients A and B do not control the tone volume itself and, hence, the sum of the balance control coefficients A and B is "1 ".

Figure 4:
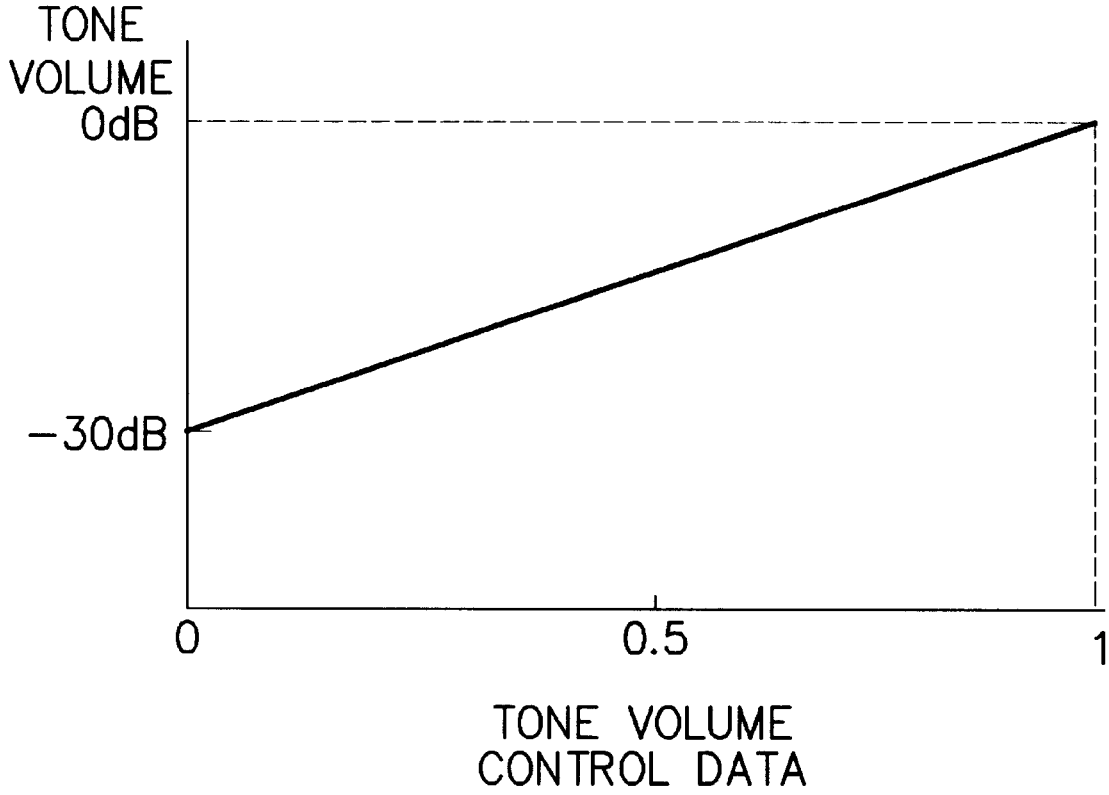
FIG. 4 is a graph showing the relationship between a tone volume control coefficient C and tone volume control data value.

The tone volume control coefficient C is used to control the overall tone volume of tones to be generated by the electronic musical instrument, and linearly changes the tone volume upon hearing in proportion to a change in tone volume control data. For example, if the tone volume dynamic range of bass and treble of the electronic musical instrument is 30 dB, the abscissa plots tone volume control data, and the ordinate plots the tone volume, as shown in FIG. 4, the value of the tone volume control coefficient C changes to obtain a change in tone volume indicated by a straight line that connects a point (tone volume control data, tone volume)=(minimum "0", −30 dB), and a point (maximum "1", 0 dB).

The multiplier 204*a* multiplies the tone signal supplied from the sound source 109 by the balance control coefficient B generated by the control coefficient generator 203, and the multiplier 204*b* multiplies the tone signal, which is corrected according to the hearing correction characteristics and is supplied from the filter 201, by the balance control coefficient A generated by the control coefficient generator 203.

An adder 205 adds the tone signals as the products of the multipliers 204*a* and 204*b* to generate and output a tone signal which can assure a constant tone volume balance upon hearing of tones to be generated by the electronic musical instrument independently of the tone volume.

The multiplier 206 multiplies the tone signal output from the adder 205 by the tone volume control coefficient C generated by the control coefficient generator 203 to control the tone volume of the tone signal output from the adder 205. In this way, the tone volume controller 110 outputs the tone signal, the tone volume of which is controlled without changing the tone volume balance upon hearing, and actual tones are produced from the loudspeaker 114 via the D/A converter 112 and amplifier 113. The multipliers 204*a*, 204*b*, and 206, and the adder 205 form a mixing unit of the present invention, the multipliers 204*a* and 204*b* and the adder 205 form a balance adjustment unit of the present invention, and the multiplier 206 forms a tone volume adjustment unit of the present invention.

If X ($0 \leqq X \leqq 1$) represents the value of tone volume control data, the balance control coefficients A and B and the tone volume control coefficient C are obtained by:

$$A=(10^{0.7X}-10^{0.7})/(1-10^{0.7}) \quad (1)$$

$$B=1-A \quad (2)$$

$$C=10^{1.5}(X-1) \quad (3)$$

Especially, in this embodiment, since the tone volume controller 110 comprises a DSP, approximations of equations (1) to (3) are described by:

$$A = \frac{0.3976X^3}{KA3} - \frac{0.171X^2}{KA2} - \frac{0.4301X}{KA1} + 1 \quad (4)$$

$$B=1=A \quad (5)$$

$$C = \frac{1.2229X^4}{KC4} - \frac{0.9756X^3}{KC3} + \frac{0.6742X^2}{KC2} + \frac{0.0449X}{KC1} + \frac{0.0325}{KC0} \quad (6)$$

Figure 5:
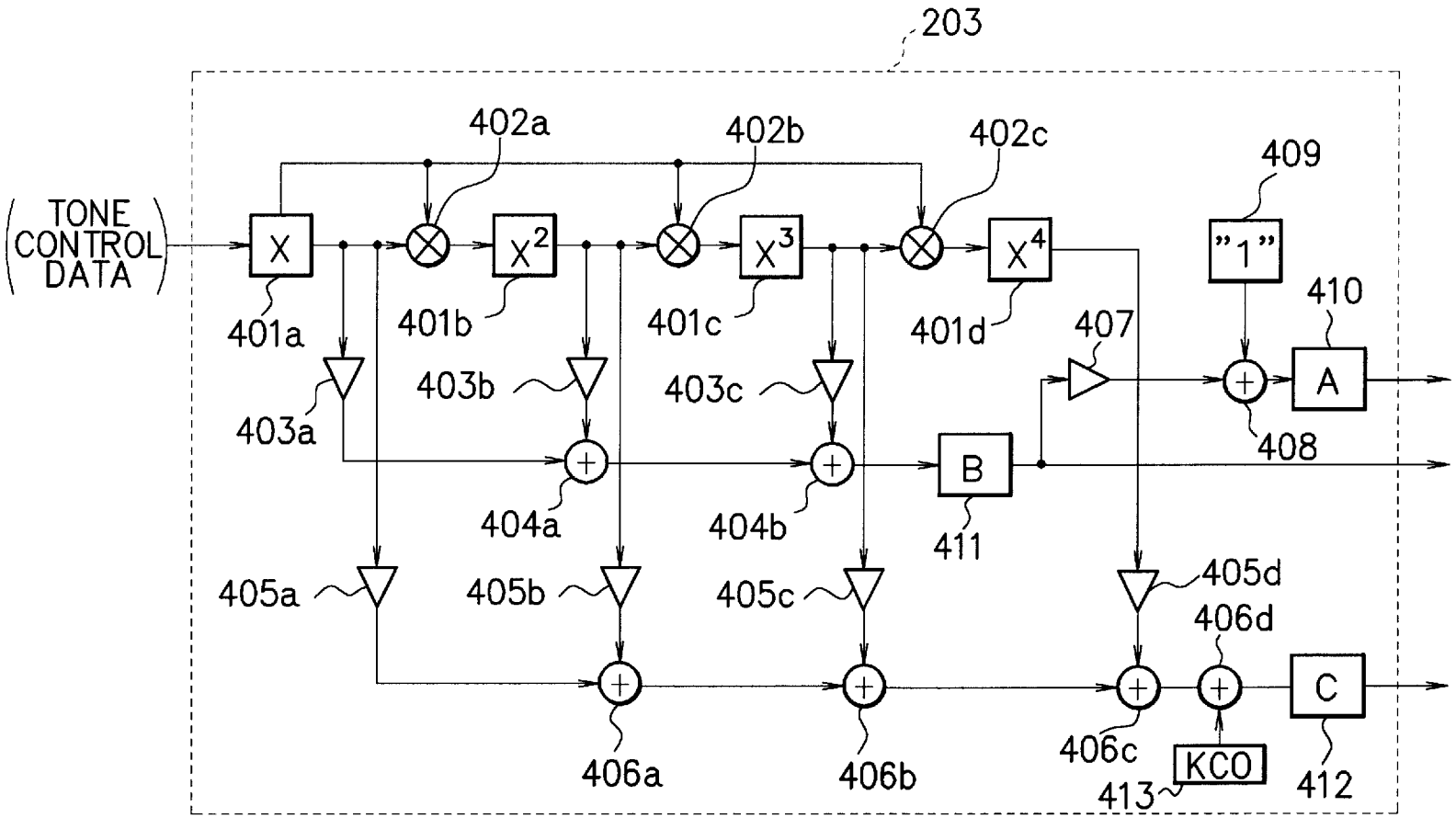
FIG. 5 is a block diagram showing an example of the arrangement of a control coefficient generator 203 shown in FIG. 2.

FIG. 5 shows an example of the arrangement of the control coefficient generator 203 which generates the balance control coefficients A and B and the tone volume control coefficient C from the received tone volume control data in accordance with equations (4) to (6).

Referring to FIG. 5, reference numerals 401*a* to 401*d*, and 409 to 413 denote registers for temporarily holding values and outputting the held values. The registers 401*a* to 401*d* respectively hold and output the 1st, 2nd, 3rd, and 4th powers of the value X of the received tone volume control data. The register 409 holds and outputs a fixed value "1", and the registers 410 to 412 respectively hold and output the balance control coefficients A and B and the tone volume control coefficient C. The register 413 holds and outputs the value KCO in equation (6).

Multipliers 402*a* to 402*c* calculate the powers of the value X of the tone volume control data. The multipliers 402*a* to 402*c* receive the 1st, 2nd, and 3rd powers of the value X of the tone volume control data output from the registers 401*a* to 401*c*, also receive the value X of the tone volume control data output from the register 401*a*, and multiply these values to calculate the powers of the value X of the tone volume control data.

Multipliers 403*a* to 403*c* and the adders 404*a* and 404*b* are used to calculate the balance control coefficient B, and the multipliers 403*a* to 403*c* receive the values KA1 to KA3 in equation (4) as multiplication coefficients. The products output from the multipliers 403*a* to 403*c* are added by the adders 404*a* and 404*b* to calculate the balance control coefficient B.

Multipliers 405*a* to 405*d* and adders 406*a* to 406*d* are used to calculate the tone volume control coefficient C, and the multipliers 405*a* to 405*d* receive the values KC1 to KC4 in equation (6) as multiplication coefficients. The products of the multipliers 405*a* to 405*d* are added by the adder 406*a* to 406*c*, and the adder 406*d* adds the value KC0 held by the register 413 to the sum, thus calculating the tone volume control coefficient C.

A multiplier 407 and adder 408 are used to calculate the balance control coefficient A using the balance control coefficient B calculated as described above. The sign of the value output from a register 411 is inverted by the multiplier 407, and "1" is added to the inverted value by the adder 408, thus calculating the balance control coefficient A.

Note that the value KC0 held in the register 413 and the values KA1 to KA3 and KC1 to KC4 respectively supplied to the multipliers 403*a* to 403*c* and 405*a* to 405*d* as multiplication coefficients are stored in the coefficient memory 107*c* in the ROM 107 shown in FIG. 1, and these values are read out and supplied by the CPU 101 upon power ON.

Figure 6:
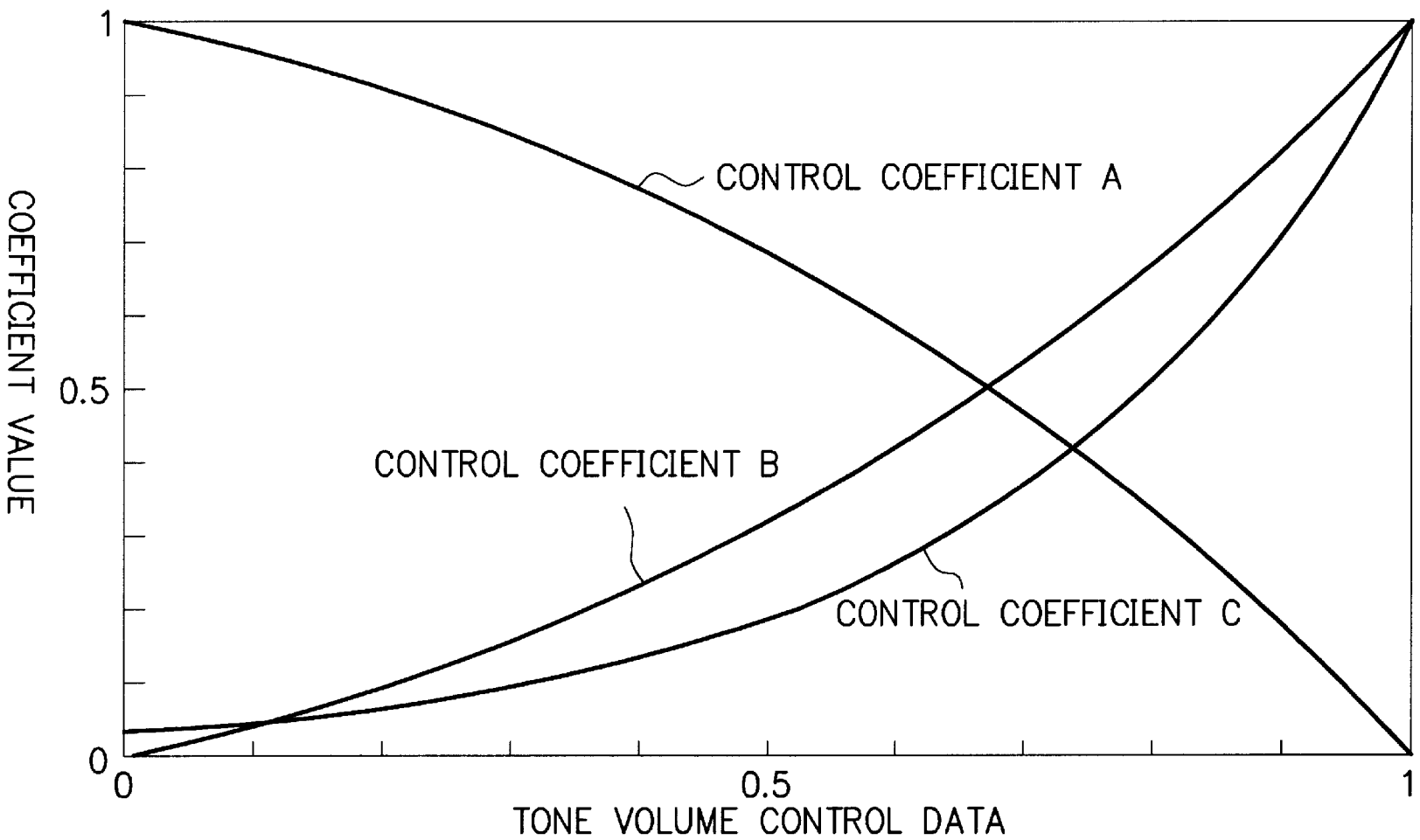
FIG. 6 is a graph showing the relationship between the coefficient values of balance control coefficients A and B and the tone volume control coefficient C, and the tone volume control data value.

FIG. 6 shows the relationship between the coefficient values of the balance control coefficients A and B, and the tone control coefficient C generated by the control coefficient generator 203 by the above method, and the value X of the tone volume control data.

In FIG. 6, the abscissa plots the value X ($0 \leqq X \leqq 1$) of the tone volume control data, and the ordinate plots the coefficient value ($0 \leqq$ coefficient value $\leqq 1$).

As shown in FIG. 6, when the value X of the tone volume control data is "1" (maximum tone volume), the balance control coefficient A is "0", and the balance control coefficient B is "1". That is, a tone signal, that does not contain any tone signal which is corrected according to the hearing correction characteristics and is supplied from the filter 201, is directly output from the adder 205. At this time, frequency characteristics (to be referred to as "correction frequency characteristics" hereinafter) when the filter 201, multipliers 204*a* and 204*b*, and adder 205 are considered as a single correction filter correspond to frequency characteristics F71 shown in FIG. 7.

Figure 8:
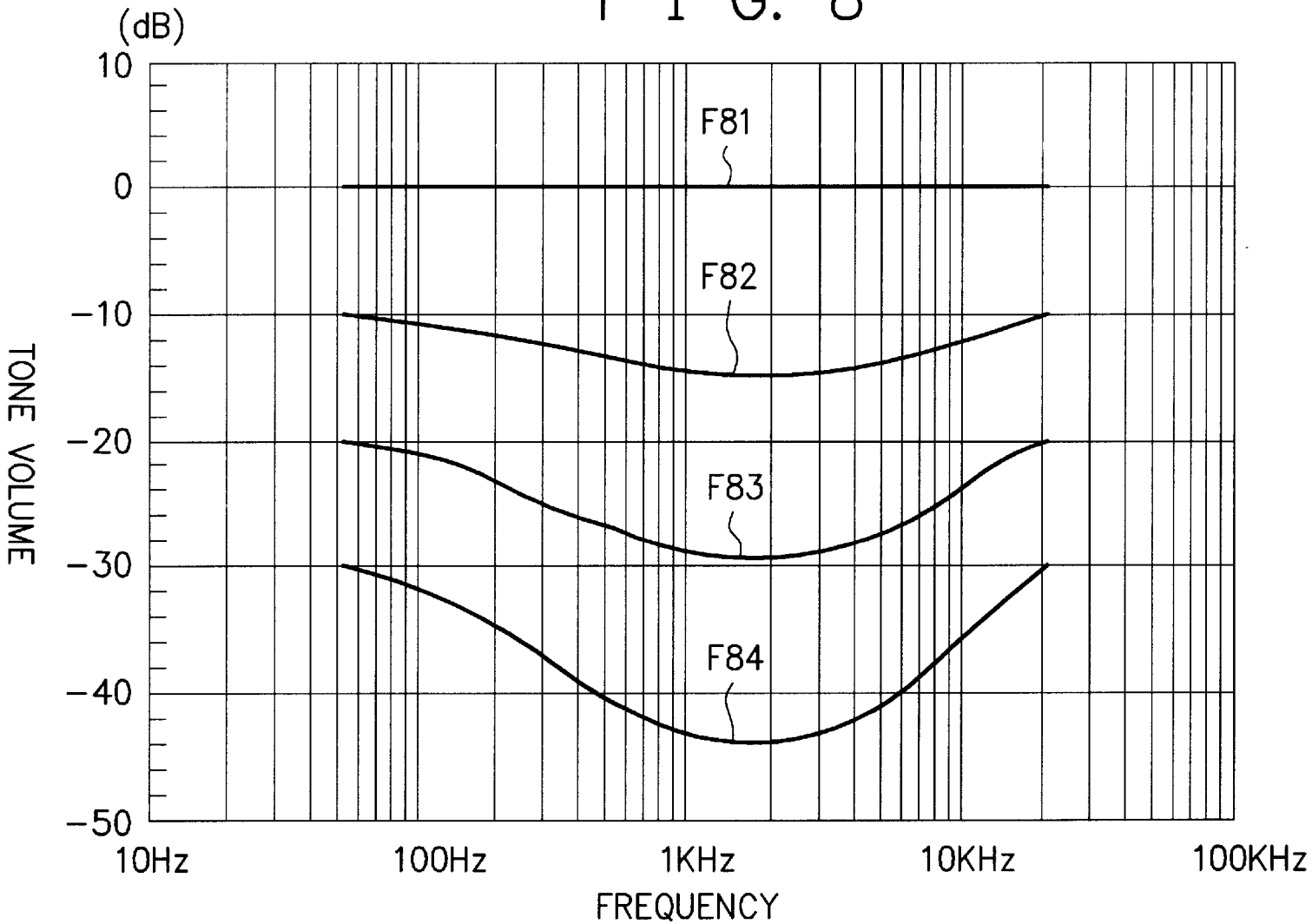
FIG. 8 is a graph for explaining the frequency characteristics of tone signals output from a multiplier 206 shown in FIG. 2.

At this time, the tone volume control coefficient C is "1", and a tone signal, the tone volume of which is not changed by the multiplier 206, and which is corrected according to frequency characteristics F81 shown in FIG. 8, is output from the tone volume controller 110. Note that FIGS. 7 and 8 will be described later.

When control is made to reduce the tone volume from a state wherein the value X of the tone volume control data is "1" (maximum tone volume), the balance control coefficient A gradually becomes larger and the balance control coefficient B gradually becomes smaller with decreasing value X of the tone volume control data.

For example, when the value X of the tone volume control data is "0.67", the balance control coefficient A is "0.515", and the balance control coefficient B is "0.485". That is, a tone signal, which is corrected according to the hearing correction characteristics and is supplied from the filter 201, and a tone signal supplied from the sound source 109 are added at a ratio (0.515):(0.485) by the adder 205, and the sum signal is output. The correction frequency characteristics at that time correspond to frequency characteristics F72 shown in FIG. 7. The tone volume control coefficient C at that time is "0.320", the multiplier 206 multiplies the tone signal output from the adder 205 by the tone volume control coefficient C, and the tone volume controller 110 outputs a tone signal which is corrected according to frequency characteristics F82 shown in FIG. 8.

For example, when the value X of the tone volume control data is "0.33", the balance control coefficient A is "0.825", and the balance control coefficient B is "0.175". That is, a tone signal, which is corrected according to the hearing correction characteristics and is supplied from the filter 201, and a tone signal supplied from the sound source 109 are added at a ratio (0.825):(0.175) by the adder 205, and the sum signal is output. The correction frequency characteristics at that time correspond to frequency characteristics F73 shown in FIG. 7, and the tone volume of midrange tones based on the tone signal is smaller about 10 dB than bass and treble tones. The tone volume control coefficient C at that time is "0.175", the multiplier 206 multiplies the tone signal output from the adder 205 by the tone volume control coefficient C, and the tone volume controller 110 outputs a tone signal which is corrected according to frequency characteristics F83 shown in FIG. 8.

When control is made to further reduce the tone volume (to decrease the value X of the tone volume control data), the value X of the tone volume control data becomes "0" (minimum tone volume), the balance control coefficient A becomes "1", and the balance control coefficient B becomes "0". That is, only a tone signal, which is corrected according to the hearing correction characteristics and is supplied from the filter 201, is output from the adder 205. The correction frequency characteristics at that time correspond to frequency characteristics F74 shown in FIG. 7, and the tone volume of midrange tones based on the tone signal is 14 dB smaller than that of bass and treble tones.

The tone volume control coefficient C at that time is "0.032", the multiplier 206 multiplies the tone signal output from the adder 205 by the tone volume control coefficient C, and the tone volume controller 110 outputs a tone signal which is corrected according to frequency characteristics F84 shown in FIG. 8. The tone volume of bass and treble tones based on the tone signal, which is corrected according to the frequency characteristics F84, becomes smaller by 30 dB, and that of midrange tones becomes smaller by 44 dB.

FIG. 7 is a graph for explaining the frequency characteristics of tone signals output from the adder 205 shown in FIG. 2.

In FIG. 7, the abscissa plots the frequency, and the ordinate plots the tone volume. In FIG. 7, since the overall tone volume of tone signals output from the adder 205 is not controlled, bass and treble frequency characteristics are present near 0 dB. Midrange frequency characteristics change in the order of frequency characteristics F71→F72→F73→F74 as the tone volume becomes smaller, thus controlling the midrange tone volume to decrease with decreasing tone volume.

FIG. 8 is a graph for explaining the frequency characteristics of tone signals output from the multiplier 206 shown in FIG. 2.

In FIG. 8, the abscissa plots the frequency, and the ordinate plots the tone volume. The frequency characteristics shown in FIG. 8 are obtained by further executing the tone volume control of the tone signal, which is corrected according to the frequency characteristics shown in FIG. 7, by the multiplier 206. The frequency characteristics F81 are the same as the frequency characteristics F71 shown in FIG. 7, and the frequency characteristics F82 are obtained by reducing the frequency characteristics F72 shown in FIG. 7 as a whole by 10 dB. Likewise, the frequency characteristics F83 are obtained by reducing the frequency characteristics F73 shown in FIG. 7 as a whole by 20 dB, and the frequency characteristics F84 are obtained by reducing the frequency characteristics F74 shown in FIG. 7 as a whole by 30 dB.

The operation will be described below.

The operation of a main process of the electronic musical instrument shown in FIG. 1 will be explained first, and the tone volume control will then be explained.

(Main Process)

When the power switch of the electronic musical instrument shown in FIG. 1 is turned on (power ON), the CPU 101, the RAMs 106 and 111, the DSP which forms the tone volume controller 110, and the like are initialized.

The initialization process includes a process in which the CPU 101 reads out coefficients stored in the coefficient memory 107*c* in the ROM 107, and supplies the readout coefficients to the DSP that forms the tone volume controller 110. The coefficients include the filter coefficients of the filter 201, and those used in arithmetic operations of the control coefficients (balance control coefficients A and B and tone volume control coefficient C) by the control coefficient generator 203 in the tone volume controller 110.

When the CPU 101 supplies the filter coefficients, the coefficients used to compute the control coefficients, and the like to the tone volume controller 110, the frequency characteristics of the filter 201, the arithmetic circuits of the control coefficients in the control coefficient generator 203, and the like are set.

Upon completion of initialization, the CPU 101 sequentially executes ① a panel event process for detecting the operation state of the control panel 103, and controlling the electronic musical instrument to operate according to the detection result, ② a pedal event process for detecting the operation state of the EXP pedal 104 based on the output of the AID converter 105, and controlling the electronic musical instrument to operate according to the detection result, ③ a keyboard event process for detecting the operation state of the keyboard unit 108 based on the output from the touch sensor 116, and controlling the electronic musical instrument to operate according to the detection result, and ④ any other process. These processes are repeated like ①→②→③→④→①→ . . . until the power switch is turned off.

For example, in ① the panel event process, when it is detected that a tone color setting switch on the control panel 103 has been operated, the CPU 101 executes a process for controlling the sound source 109 and the like to generate a tone with a tone color selected by that operation from the electronic musical instrument; when it is detected that the tone volume switch 103*a* has been operated, the CPU 101 executes a process for controlling the tone volume controller 110 and the like to generate a tone with a tone volume set according to that operation from the electronic musical instrument.

For example, in ② the pedal event process, when it is detected that the EXP pedal 104 has been operated, the CPU 101 executes a process for controlling the tone volume controller 110 and the like to generate a tone with a tone volume, which has been changed according to that operation amount, from the electronic musical instrument. For example, in ③ the keyboard event process, the CPU 101 executes a process for controlling the sound source 109 and the like on the basis of touch information, pitch (range) information, and the like of an ON key supplied from the touch sensor 116.

(Tone Volume Control Operation)

The tone volume control operation done in the electronic musical instrument will be described below.

When it is detected in ① the panel event process that the tone volume switch 103*a* has been operated or when it is detected in ② the pedal event process that the EXP pedal 104 has been operated, the CPU 101 sets the tone volume of a tone to be generated by the electronic musical instrument in accordance with the operation state of the tone volume switch 103*a* or EXP pedal 104. Information that pertains to the set tone volume is supplied from the CPU 101 to the tone volume controller 110 as tone volume control data at given time intervals. Note that the CPU 101 may set the tone volume of a tone to be generated by the electronic musical instrument in accordance with MIDI data input via the MIDI interface 102.

Upon generating a tone from the electronic musical instrument on the basis of the operation state (touch information, pitch information, and the like of an ON key) of the keyboard unit 108 supplied from the touch sensor 116 in ③ the keyboard event process, the CPU 101 supplies performance data to the sound source 109 on the basis of the operation state. The sound source 109 generates a tone signal according to the performance data and supplies it to the tone volume controller 110.

Upon receiving the tone signal, the tone volume controller 110 supplies the received tone signal to the multiplier 204*a*, and corrects the tone signal according to the hearing correction characteristics using the filter 201 and supplies the corrected tone signal to the multiplier 204*b*.

In the tone volume controller 110, the data interpolation unit 202 makes data interpolation of the tone volume control data supplied from the CPU 101, and supplies the tone volume control data that have undergone data interpolation to the control coefficient generator 203. The control coefficient generator 203 makes given arithmetic operations based on the received tone volume control data that have undergone data interpolation to calculate the balance control coefficients A and B and the tone volume control coefficient C. Note that calculations of the balance control coefficients A and B and the tone volume control coefficient C are always in progress.

The multiplier 204*a* then multiplies the received tone signal by the balance control coefficient B, and the multiplier 204*b* similarly multiplies the tone signal, which is corrected according to the hearing correction characteristics, by the balance control coefficient A. The tone signals as the products output from the multipliers 204*a* and 204*b* are supplied to and added to each other by the adder 205. Therefore, the multipliers 204*a* and 204*b* and the adder 205 generate the tone signal which is corrected to obtain a constant tone volume balance upon hearing.

The tone signal as the sum output from the adder 205 is supplied to the multiplier 206 and undergoes a multiplication process for controlling the overall tone volume. That is, the multiplier 206 multiplies the sum tone signal by the tone volume control coefficient C.

The tone signal as the product from the multiplier 206 is supplied to the D/A converter 112, which converts the tone signal into an analog signal, thus producing a tone from the loudspeaker 114 via the amplifier 113.

In this manner, the tone volume control (control of the tone volume balance and the overall tone volume) of a tone to be generated is done.

As described in detail above, according to this embodiment, the multipliers 204*a* and 204*b* respectively multiply the received tone signal and the tone signal, which is corrected according to the hearing correction characteristics, by the balance control coefficients B and A which are generated by the control coefficient generator 203 and are used to control the tone volume balance, and the adder 205 then adds these product signals. The multiplier 206 multiplies the sum tone signal output from the adder 205 by the tone volume control coefficient C which is generated by the control coefficient generator 203 and is used to control the tone volume, and outputs the product signal to the D/A converter 112.

In this way, a tone signal, to which the frequency characteristics for correcting hearing characteristics are given in accordance with the tone volume control data, i.e., the tone volume of a tone to be generated, can be generated and output. Even when the tone volume of a tone to be generated by the electronic musical instrument is changed, the tone volume balance upon hearing among tone colors of tones to be generated by the electronic musical instrument can be maintained, and the tone colors upon hearing can be maintained.

Since the tone volume balance and tone colors upon hearing of tones remain unchanged independently of the tone volume of tones to be generated, natural tones can be obtained even when the tone volume has been changed during a performance.

The tone volume balance upon hearing of tones to be generated is adjusted by the multipliers 204*a* and 204*b* and the adder 205 on the basis of the received tone signal and the tone signal which is corrected according to the hearing correction characteristics, and the overall tone volume of tones to be generated is adjusted by the multiplier 206 on the basis of the received tone signal and the corrected tone signal. Hence, the tone volume balance upon hearing and the tone volume can be easily independently adjusted in accordance with the tone volume of tones to be generated, and a tone signal, to which the frequency characteristics for correcting hearing characteristics are given in accordance with the tone volume of a tone to be generated, can be generated and output. Therefore, even when the tone volume of tones to be generated by the electronic musical instrument has been changed, the tone volume balance upon hearing among tone colors and the tone colors upon hearing of tones to be generated by the electronic musical instruments can be maintained.

The data interpolation unit 202 makes data interpolation of the tone volume control data supplied from the CPU 101, and the control coefficient generator 203 generates the balance control coefficients A and B and the tone volume control coefficient C on the basis of the tone volume control data that have undergone data interpolation. Hence, even when the set tone volume has been abruptly changed by, e.g., the tone volume switch 103*a*, the tone volume of tones to be generated can be controlled to change smoothly. Therefore, generation of discontinuous tone signals, i.e., that of noise can be prevented, and the load on the CPU 101 can be reduced.

Since the frequency characteristics of the filter 201 having hearing correction characteristics are set using the coefficients stored in the coefficient memory 107*c* in the ROM 107, the hearing correction characteristics of the filter 201 can be controlled in correspondence with the hearing characteristics according to, e.g., the use location of the electronic musical instrument by changing the coefficients stored in the coefficient memory 107*c*.

Since all the processes in the tone volume controller 110 are implemented by digital processes, the tone volume controller 110 can be easily constructed by a DSP.

Second Embodiment

The second embodiment of the present invention will be described below with reference to the accompanying drawings.

In the electronic musical instrument according to the first embodiment, the multipliers 204*a* and 204*b* on the input side of the tone volume controller 110 respectively multiply a tone signal supplied from the sound source 109 and that supplied from the filter 201 by the corresponding coefficients, the adder 205 adds the product signals, and the multiplier 206 on the output side then controls the overall tone volume of the sum signal to output a tone signal. However, in an electronic musical instrument according to the second embodiment, only multipliers 204*a*' and 204*b*' on the input side execute multiplication processes for controlling the tone volume balance upon hearing and the overall tone volume without using any multiplier on the output side, and the adder 205 adds the product signals to output the sum signal.

Note that the overall arrangement of the electronic musical instrument according to the second embodiment is the same as that of the electronic musical instrument according to the first embodiment shown in FIG. 1, and a detailed description thereof will be omitted.

Figure 9:
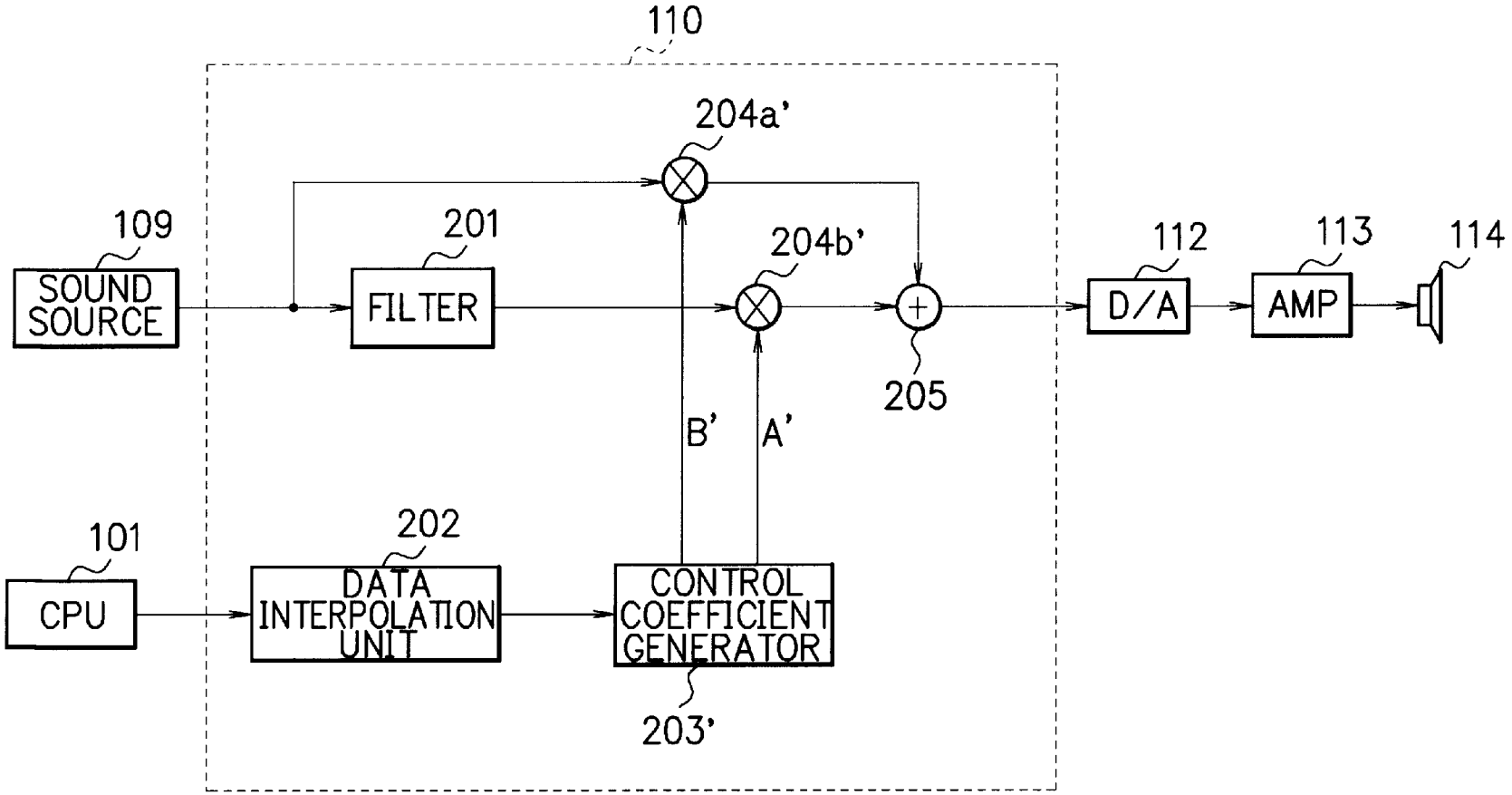
FIG. 9 is a block diagram showing the detailed arrangement of a tone volume controller 110 of an electronic musical instrument according to the second embodiment.

FIG. 9 is a block diagram showing an example of the detailed arrangement of the tone volume controller 110 of the electronic musical instrument according to the second embodiment. Note that the same reference numerals in FIG. 9 denote the same blocks as those shown in FIGS. 1 and 2, and a repetitive description thereof will be omitted. Also, is attached to reference symbols of blocks which are not the same as those shown in FIG. 2 but have the same functions.

Referring to FIG. 9, reference numeral 203' denotes a control coefficient generator for generating tone volume control coefficients A' and B' from tone volume control data that have undergone data interpolation by the data interpolation unit 202, and supplying them to multipliers 204*b*' and 204*a*', respectively. The control coefficient generator 203' forms a coefficient generation unit of the present invention.

The tone volume control coefficients A' and B' are control coefficients used to adjust the tone volume balance upon hearing between a tone signal which is corrected according to the hearing correction characteristics and is supplied from the filter 201, and a tone signal supplied from the sound source 109, and to control the overall tone volume of tones to be generated by the electronic musical instrument.

The multiplier 204*a*' multiplies a tone signal supplied from the sound source 109 by the tone volume control coefficient B' generated by the control coefficient generator 203', and the multiplier 204*b*' multiplies a tone signal, which is corrected according to the hearing correction characteristics and is supplied from the filter 201, by the tone volume control coefficient A' generated by the control coefficient generator 203'.

The adder 205 adds the tone signals as the products output from the multipliers 204*a*' and 204*b*', and outputs a tone signal, the tone volume balance upon hearing and the overall tone volume of which have been controlled. The tone signal output from the adder 205 produces actual tones from the loudspeaker 114 via the D/A converter 112 and amplifier 113. The multipliers 204*a*' and 204*b*' and the adder 205 form a mixing unit of the present invention.

If X ($0 \leqq X \leqq 1$) represents the value of tone volume control data, the tone volume control coefficients A' and B' are obtained by computing equations (1) to (3) used to obtain the balance control coefficients A and B and the tone volume control coefficient C of the first embodiment like the tone volume control coefficient A'=A×C and tone volume control coefficient B'=B×C, i.e., are given by:

$$A' = -\frac{2.6141X^5}{KA5'} + \frac{4.3147X^4}{KA4'} - \frac{2.6027X^3}{KA3'} + \frac{0.8369X^2}{KA2'} + \frac{0.034X}{KA1'} + \frac{0.0327}{KA0'} \quad (7)$$

$$B' = \frac{3.327X^5}{KB5'} - \frac{4.8355X^4}{KB4'} + \frac{3.0964X^3}{KB3'} - \frac{0.6512X^2}{KB2'} + \frac{0.0614X}{KB1'} \quad (8)$$

Figure 10:
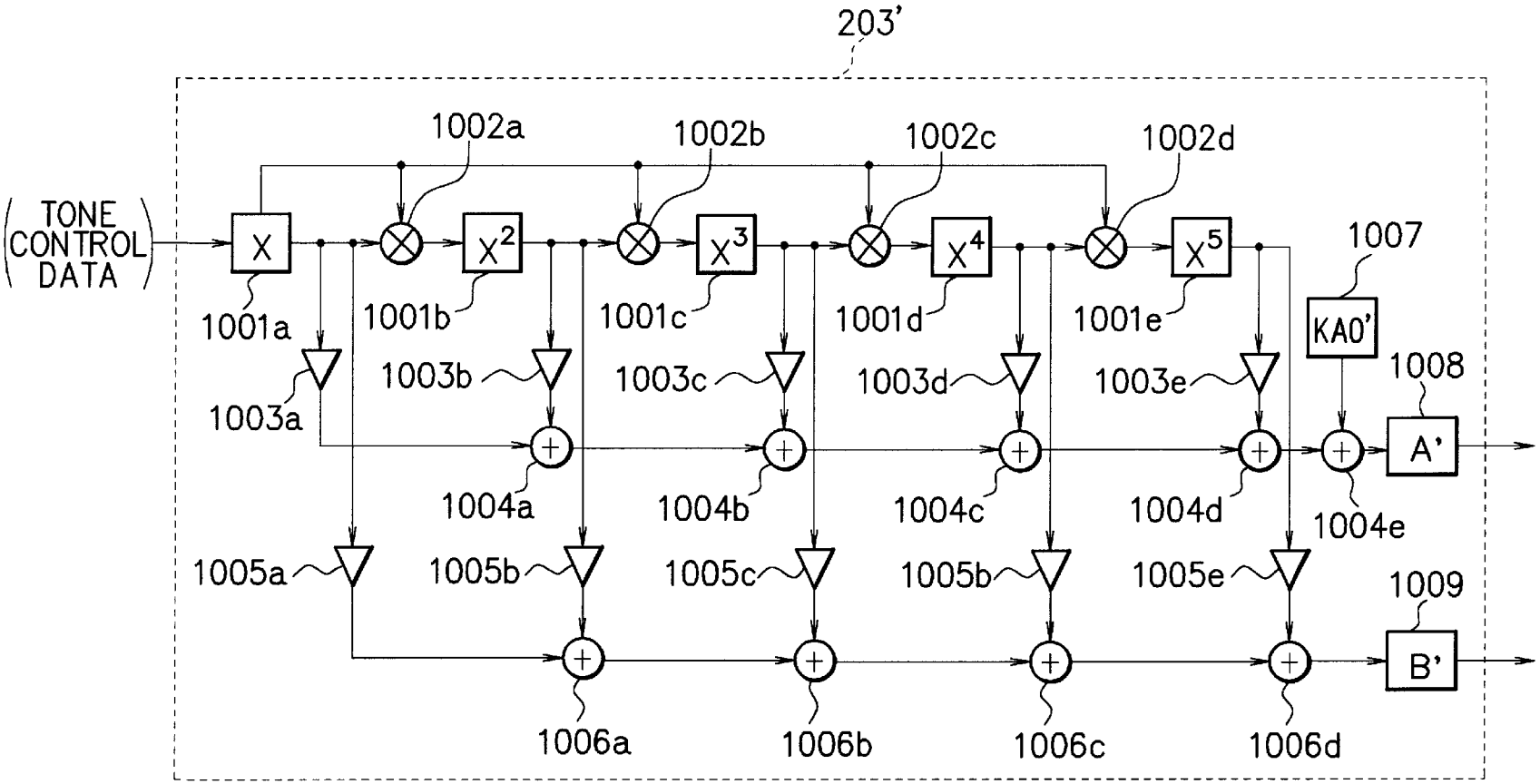
FIG. 10 is a block diagram showing an example of the arrangement of a control coefficient generator 203' shown in FIG. 9.

FIG. 10 shows an example of the arrangement of the control coefficient generator 203' which generates the tone volume control coefficients A' and B' from the received tone volume control data in accordance with equations (7) and (8) above.

Referring to FIG. 10, reference numerals 1001*a* to 1001*e* and 1007 to 1009 denote registers for temporarily holding values and outputting the held values. The registers 1001*a* to 1001*e* respectively hold and output the 1st, 2nd, 3rd, 4th, and 5th powers of the value X of the received tone volume control data. The register 1007 holds and outputs the value KA0' in equation (7), and the registers 1008 and 1009 respectively hold and output the tone volume control coefficients A' and B'.

Multipliers 1002*a* to 1002*d* calculate the powers of the value X of the tone volume control data. The multipliers 1002*a* to 1002*d* respectively receive the 1st, 2nd, 3rd, and 4th powers of the value X of the tone volume control data output from the registers 1001*a* to 1001*d*, and also the value X of the tone volume control data output from the register 101*a*, and multiply them to calculate the powers of the value X of the tone volume control data.

Multipliers 1003*a* to 1003*e* and adders 1004*a* to 1004*e* calculate the tone volume control coefficient A'. The multipliers 1003*a* to 1003*e* respectively receive the values KA1' to KA5' in equation (7) as multiplication coefficients. The products output from the multipliers 1003*a* to 1003*e* are added in turn by the adders 1004*a* to 1004*d*, and the sum output from the adder 1004*d* is added to the value held by the register 1007 by the adder 1004*e*, thus calculating the tone volume control coefficient A'.

Likewise, multipliers 1005*a* to 1005*e* and adders 1006*a* to 1006*d* calculate the tone volume control coefficient B'. The multipliers 1005*a* to 1005*e* respectively receive the values KB1' to KB5' in equation (8) as multiplication coefficients. The products from the multipliers 1005*a* to 1005*e* are added in turn using the adders 1006*a* to 1006*d* to calculate the tone volume control coefficient B'.

Note that the value KA0' held in the register 1007, and the values KA1' to KA5' and KB1' to KB5' to be supplied as multiplication coefficients to the multipliers 1003*a* to 1003*e* and 1005*a* to 1005*e* are stored in the coefficient memory in the ROM, as in the first embodiment. These values are read out and supplied by the CPU upon power ON.

Figure 11:
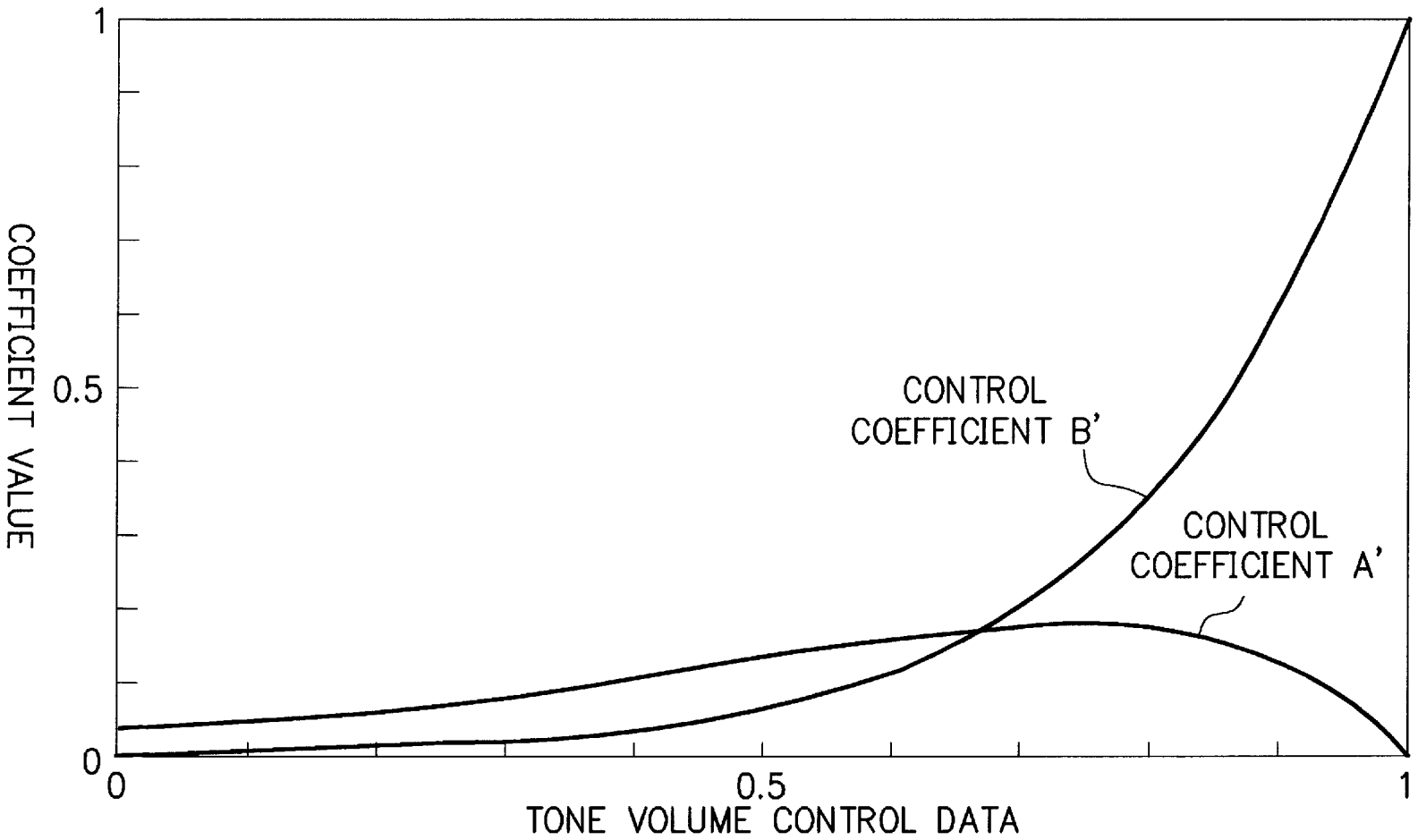
FIG. 11 is a graph showing the relationship between the coefficient values of tone volume control coefficients A' and B', and tone volume control data value.

FIG. 11 shows the relationship between the tone volume control coefficients A' and B' generated by the control coefficient generator 203', and the value of the tone volume control data.

In FIG. 11, the abscissa plots the value X ($0 \leqq X \leqq 1$) of the tone volume control data, and the ordinate plots the coefficient value ($0 \leqq$ coefficient value $\leqq 1$).

As shown in FIG. 11, when the value X of the tone volume control data is "1" (maximum tone volume), the tone volume control coefficient A' is "0", and the tone volume control coefficient B' is "1". That is, a tone signal supplied from the sound source 109 is directly output from the adder 205.

When control is made to reduce the tone volume from a state wherein the value X of the tone volume control data is "1" (maximum tone volume), the tone volume control coefficient A' gradually becomes larger and the tone volume control coefficient B' gradually becomes smaller with decreasing value X of the tone volume control data.

However, since the tone volume control coefficients A' and B' of this embodiment control the entire tone volume together with the tone volume balance upon hearing, the tone volume control coefficient A' exhibits a maximum value at a certain value X of the tone volume control data instead of monotonously increasing, and becomes smaller as the value X of the tone volume control data decreases further from that value.

When control is made to further reduce the tone volume (to decrease the value X of the tone volume control data), and the value X of the tone volume control data reaches "0" (minimum tone volume) at last, the tone volume control coefficient B' assumes "0", but the tone volume control coefficient A' assumes a nonzero value albeit small. At this time, only a tone signal which is corrected according to the hearing correction characteristics and is supplied from the filter 201 is output from the adder 205.

In this manner, the frequency characteristics shown in FIG. 8 of the first embodiment can be implemented by the tone volume control coefficients A' and B' shown in FIG. 11.

The operation will be explained below.

Note that the operation of the main process of the electronic musical instrument according to the second embodiment is the same as that of the first embodiment, and a detailed description thereof will be omitted. Only the tone volume control operation will be explained below.

(Tone Volume Control Operation)

When it is detected in the panel event process that the tone volume switch 103*a* has been operated or when it is detected in the pedal event process that the EXP pedal 104 has been operated, as in the first embodiment, the CPU 101 sets the tone volume of tones to be generated by the electronic musical instrument in accordance with that operation state. The CPU 101 then supplies information that pertains to the set tone volume to the tone volume controller 110 as tone volume control data at given time intervals.

In the keyboard event process, the CPU 101 supplies performance data to the sound source 109 on the basis of the operation state (touch information, pitch information, and the like of an ON key) of the keyboard unit 108 supplied from the touch sensor 116. The sound source 109 generates a tone signal in accordance with the performance data, and supplies it to the tone volume controller 110.

Upon receiving the tone signal, the tone volume controller 110 supplies the received tone signal to the multiplier 204*a*', corrects that signal in accordance with the hearing correction characteristics using the filter 201, and supplies the corrected signal to the multiplier 204*b*'.

In the tone volume controller 110, the data interpolation unit 202 makes data interpolation of the tone volume control data supplied from the CPU 101, and supplies the tone volume control data that have undergone data interpolation to the control coefficient generator 203'. The control coefficient. generator 203' makes given arithmetic operations based on the received tone volume control data that have undergone data interpolation to calculate the tone volume control coefficients A' and B'. Note that calculations of the tone volume control coefficients A' and B' are always in progress.

The multiplier 204*a*' multiplies the received tone signal by the tone volume control coefficient B', and the multiplier 204*b*' multiplies the tone signal that has been corrected according to the hearing correction characteristics by the tone volume control coefficient A'. The tone signals as the product signals output from the multipliers 204*a*' and 204*b*' are supplied to and added to each other by the adder 205, and the sum signal is supplied to the D/A converter 112. That is, the multipliers 204*a*' and 204*b*' and the adder 205 generate a tone signal which is corrected to have a constant tone volume balance upon hearing and the overall tone volume of which is controlled.

The tone signal supplied to the D/A converter 112 is converted into an analog signal by the D/A converter 112, thus producing actual tones from the loudspeaker 114 via the amplifier 113.

As described above, according to the second embodiment, the multipliers 204*a*' and 204*b*' respectively multiply the received tone signal and the tone signal which is corrected according to the hearing correction characteristics by the tone volume control coefficients B' and A' which are generated by the control coefficient generator 203' on the basis of the tone volume control data and are used to control the tone volume balance and tone volume, and the adder 205 adds these product signals. The sum signal is then output to the D/A converter 112.

In this manner, a tone signal, to which the frequency characteristics for correcting hearing characteristics are given in accordance with the tone volume of a tone to be generated, can be generated and output on the basis of the received tone signal as in the first embodiment. Even when the tone volume of a toe to be generated by the electronic musical instrument is changed, the tone volume balance upon hearing among tone colors of tones to be generated by the electronic musical instrument can be maintained, and the tone colors upon hearing can be maintained.

Since the multipliers 204*a*' and 204*b*' and the adder 205 control the tone volume balance upon hearing of tones to be generated together with the tone volume on the basis of the received tone signal and the tone signal which is corrected according to the hearing correction characteristics, both the tone volume balance upon hearing and the tone volume can be controlled by a simple arrangement.

In the first and second embodiments described above, the tone volume controller 110 uses a DSP. However, the present invention is not limited to the DSP, and the same functions may be realized by circuit elements having single permanent functions, e.g., an addition function, filter function, and the like.

In the first and second embodiments, the filter 201 comprises one second-order IIR filter. However, an IIR filter of the third order or higher, or an FIR filter may be used. Also, the number of IIR filters is not limited to one, but a plurality of IIR filters may be connected.

As described above, according to the present invention, upon generating tones based on a tone signal, a filter having hearing correction characteristics corrects the tone signal, and the received tone signal and the corrected tone signal are mixed and output at a given ratio on the basis of the tone volume control information used to control the tone volume of tones to be generated. Therefore, a tone signal to which the frequency characteristics for correcting the hearing characteristics are given can be generated and output in accordance with the tone volume of tones to be generated, and the tone volume balance among tone colors of tones to be generated by the electronic musical instrument and the tone colors themselves upon hearing can be maintained independently of the tone volume of tones to be generated.

Since the tone volume balance upon hearing of tones and their tone colors remain the same. independently of the tone volume of tones to be generated, natural tones can be obtained even when the tone volume has been changed during a performance.

Upon mixing the received tone signal and the tone signal corrected by the filter having the hearing correction characteristics, when the tone volume balance among tones to be generated and the tone volume are separately adjusted on the basis of the received tone signal and the corrected tone signal, the tone volume balance and the tone volume can be independently adjusted, and a tone signal to which the frequency characteristics for correcting the hearing characteristics can be easily generated and output. Hence, the balance among tone colors of tones to be generated by the electronic musical instrument and the tone colors themselves upon hearing can be maintained.

What is claimed is:

1. An electronic musical instrument for generating a tone on the basis of a tone signal, comprising:

a filter having hearing correction characteristics for correcting the tone signal, wherein the hearing correction characteristics provide same tone volume balance and tone colors of tones upon hearing, as those tones generated at a large tone volume upon generating tones on basis of tone signals at a minimum tone volume that the electronic musical instrument can generate; and a mixing unit for mixing a received tone signal and the tone signal corrected by the filter, at a given ratio on basis of tone volume control information used to control a tone volume of the tone to be generated, and outputting the mixed signal.

2. The instrument according to claim 1, further comprising a coefficient generation unit for generating coefficients on the basis of the tone volume control information, and wherein the mixing unit mixes the received tone signal and the tone signal corrected by the filter, at the given ratio in accordance with coefficients generated by the coefficient generation unit, and outputs the mixed signal.

3. The instrument according to claim 2, wherein the mixing unit comprises:

multipliers for multiplying the received tone signal and the tone signal corrected by the filter by the respective coefficients; and an adder for adding the outputs from the multipliers.

4. The instrument according to claim 3, wherein the coefficients are coefficients for controlling a tone volume balance of tones to be generated, and the tone volume.

5. The instrument according to claim 2, wherein the mixing unit comprises:

a balance adjustment unit for adjusting, on the basis of the coefficients, a tone volume balance of tones to be generated based on the received tone signal and the tone signal corrected by the filter; and a tone volume adjustment unit for adjusting, on the basis of the coefficient, the tone volume of tones to be generated based on the received tone signal and the tone signal corrected by the filter.

6. The instrument according to claim 5, wherein the balance adjustment unit comprises:

first multipliers for multiplying the received tone signal and the tone signal corrected by the filter by the respective coefficients; and an adder for adding the outputs from the first multipliers, and the tone volume adjustment unit comprises a second multiplier for multiplying the output from the adder by the coefficient.

7. The instrument according to claim 6, wherein the coefficients include control coefficients for controlling a tone volume balance of tones to be generated and the tone volume of the tones to be generated.

8. The instrument according to claim 2, further comprising an interpolation unit for interpolating the tone volume control information, and wherein the coefficient generation unit generates the coefficients on the basis of the tone volume control information interpolated by the interpolation unit.

9. The instrument according to claim 1, wherein the hearing correction characteristics of the filter can be controlled by a filter coefficient.

10. A tone volume control method of controlling a tone volume of a tone to be generated based on a tone signal, comprising the step of:

correcting the tone signal by a filter having hearing correction characteristics, wherein the hearing correction characteristics provide same tone volume balance and tone colors of tones upon hearing, as those tones generated at a large tone volume upon generating tones on basis of tone signals at a minimum tone volume that the electronic musical instrument can generate;

mixing a received tone signal and the tone signal corrected by the filter at a given ratio on the basis of tone volume control information used to control a tone volume of the tone to be generated, and outputting the mixed signal.

11. The method according to claim 10, wherein coefficients are generated based on the tone volume control information, the received tone signal and the tone signal corrected by the filter are mixed at the given ratio in accordance with the generated coefficients, and the mixed signal is output.

12. The method according to claim 11, wherein the received tone signal and the tone signal corrected by the filter are mixed at the given ratio by multiplying the received tone signal and the tone signal corrected by the filter by the respective coefficients, and adding products.

13. The method according to claim 11, wherein upon mixing the received tone signal and the tone signal corrected by the filter at the given ratio on basis of the coefficients, a tone volume balance of tones to be generated based on the received tone signal and the tone signal corrected by the filter is adjusted, and the tone volume of the tones to be generated is adjusted on the basis of the coefficient.

14. The method according to claim 13, wherein the tone volume balance of the tones to be generated is adjusted by multiplying the received tone signal and the tone signal corrected by the filter by the respective coefficients and adding products, and tone volume balance of the tones to be generated is adjusted by further multiplying a sum of the products by the coefficient.

* * * * *